US008991222B2

(12) United States Patent
Kim et al.

(10) Patent No.: US 8,991,222 B2
(45) Date of Patent: Mar. 31, 2015

(54) WASHING MACHINE

(71) Applicant: Samsung Electronics Co., Ltd., Suwon-si, Gyeonggi-do (KR)

(72) Inventors: Do Yeon Kim, Seoul (KR); Doo Young Ryu, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 14/184,249

(22) Filed: Feb. 19, 2014

(65) Prior Publication Data

US 2014/0165660 A1 Jun. 19, 2014

Related U.S. Application Data

(63) Continuation of application No. 12/379,607, filed on Feb. 25, 2009, now Pat. No. 8,695,382.

(30) Foreign Application Priority Data

Mar. 4, 2008 (KR) ..... 20-2008-0002833 U
Jan. 6, 2009 (KR) ..... 10-2009-0000708

(51) Int. Cl.

| | |
|---|---|
| ***D06F 35/00*** | (2006.01) |
| ***D06F 21/04*** | (2006.01) |
| ***D06F 23/02*** | (2006.01) |
| ***D06F 37/22*** | (2006.01) |
| ***D06F 37/20*** | (2006.01) |
| ***D06F 37/30*** | (2006.01) |

(52) U.S. Cl.

CPC ..... *D06F 37/22* (2013.01); *D06F 37/20* (2013.01); *D06F 37/30* (2013.01)

USPC ..... 68/23.1; 68/24; 68/140

(58) Field of Classification Search

None

See application file for complete search history.

(56) References Cited

U.S. PATENT DOCUMENTS

| | | | | |
|---|---|---|---|---|
| 3,874,490 | A | 4/1975 | McAlister | |
| 6,202,451 | B1 * | 3/2001 | Park et al. | 68/23.7 |
| 6,510,716 | B1 * | 1/2003 | Kim et al. | 68/24 |
| 6,651,527 | B2 * | 11/2003 | Hehn | 74/570.2 |
| 2006/0037635 | A1 | 2/2006 | Rhodes | |
| 2006/0191765 | A1 | 8/2006 | Ito et al. | |
| 2007/0035222 | A1 | 2/2007 | Lee et al. | |

FOREIGN PATENT DOCUMENTS

| | | |
|---|---|---|
| JP | 61203841 | 9/1986 |
| JP | 61203841 A * | 9/1986 |

OTHER PUBLICATIONS

Office Action mailed Jun. 7, 2011 in U.S. Appl. No. 12/379,607, 24 pages.

(Continued)

*Primary Examiner* — Nicole Blan
(74) *Attorney, Agent, or Firm* — Staas & Halsey LLP

(57) ABSTRACT

Disclosed herein is a washing machine that is capable of increasing a frictional force between an outer diameter of a rotary shaft and an inner race of a bearing to prevent the sliding between the rotary shaft and the bearing due to a gap between the outer diameter of the rotary shaft and the inner race of the bearing, thereby preventing creep noise from the rotary shaft. The washing machine includes at least one elastic member disposed between the outer diameter of the rotary shaft and the inner race of the bearing to prevent noise due to the sliding between the rotary shaft and the bearing.

9 Claims, 5 Drawing Sheets

(56) References Cited

OTHER PUBLICATIONS

Office Action mailed Apr. 5, 2012 in U.S. Appl. No. 12/379,607, 27 pages.

Advisory Action mailed Oct. 10, 2012 in U.S. Appl. No. 12/379,607, 7 pages.

Office Action mailed Mar. 15, 2013 in U.S. Appl. No. 12/379,607, 36 pages.

Notice of Allowance mailed Nov. 15, 2013 in U.S. Appl. No. 12/379,607, 12 pages.

Corrected Notice of Allowability Jun. 7, 2011 in U.S. Appl. No. 12/379,607, 7 pages.

U.S. Appl. No. 12/379,607, filed Feb. 25, 2009, Kim et al., Samsung Electronics Co., Ltd.

* cited by examiner

WASHING MACHINE

CROSS-REFERENCE TO RELATED APPLICATIONS

This application is a continuation of U.S. patent application Ser. No. 12/379,607, filed on Feb. 25, 2009, which is currently pending, and claims the priority benefit of Korean Utility Model Application No. 20-2008-2833, filed on Mar. 4, 2008, and Korean Patent Application No. 10-2009-0000708, filed on Jan. 6, 2009 in the Korean Intellectual Property Office, the disclosures of which are incorporated herein by reference.

BACKGROUND

1. Field

Embodiments relate to a washing machine, and, more particularly, to a washing machine of an improved structure to prevent the generation of noise and vibration between a rotary shaft and a bearing.

2. Description of the Related Art

Generally, a washing machine is classified as a pulsator type washing machine that washes laundry by rotating wash water and the laundry using a pulsator rotatably installed on the bottom of the inside of a water tub, an agitator type washing machine that washes laundry by agitating wash water and the laundry using an agitator protruding from the central region of the inside of a water tub, or a drum type washing machine that washes laundry by repeatedly lifting and dropping the laundry through the rotation of a drum accommodating the laundry.

An example of such a drum type washing machine is disclosed in U.S. Pat. No. 6,510,716 providing a drum type washing machine including a water tub, a rotary tub rotatably disposed in the water tub, the rotary tub having a rotary shaft extending to the outside of the water tub, a bearing to rotatably retain the rotary shaft, and a drive motor connected to the rotary shaft at the outside of the water tub to simultaneously rotate the rotary shaft and the rotary tub.

The disclosed drum type washing machine is capable of performing a spin-drying function as well as a washing function. During spin-drying, the rotary shaft and an inner race of the bearing to retain the rotary shaft rotate at high speed, with the result that the rotary shaft and the bearing cannot rotate at the same speed. That is, there is difference in rotation speed between the rotary shaft and the bearing.

At this time, the inner race of the bearing and the outer diameter of the rotary shaft repeatedly come into contact with each other and separate from each other due to the difference in rotation speed between the rotary shaft and the bearing, with the result that there occurs a sliding phenomenon between the bearing and the rotary shaft, which generates creep noise.

Also, between an inner race of a bearing installed at the front side of the rotary shaft and a front-side step of the rotary shaft is formed a gap which causes noise and vibration.

To solve this problem, a wave washer has been used.

However, the wave washer is installed only between the inner race of the bearing installed at the front side of the rotary shaft and the front-side step of the rotary shaft, with the result that the sliding between the bearing and the rotary shaft is not fundamentally restrained, and therefore, a noise and vibration reduction effect is insignificant. In addition, a compression force is continuously applied between the inner race of the bearing and the front-side step, with the result that the wave washer is permanently deformed, and therefore, noise and vibration increase with the increase of the use time of the washing machine. Also, a frictional force providing effect, to provide a frictional force between the rotary shaft and the inner race of the bearing such that the rotary shaft and the bearing can rotate at the same speed, is insignificant. This is because, due to the shape (wave-shaped ring) of the wave washer, the frictional force is generated only at some region where the front-side step of the rotary shaft and the front side of the inner race of the bearing come into contact with the wave shape of the wave washer.

SUMMARY

It is an aspect of embodiments to provide a washing machine that is capable of restraining sliding between a rotary shaft and a bearing and uniformly maintaining a gap between the rotary shaft and the bearing, thereby preventing creep noise and vibration.

In accordance with one aspect of embodiments, there is provided a washing machine including a rotary shaft and a bearing to rotatably retain the rotary shaft, wherein the washing machine further includes at least one elastic member disposed between an outer diameter of the rotary shaft and an inner race of the bearing to prevent noise due to a sliding between the rotary shaft and the bearing.

The at least one elastic member may include an O-ring.

The at least one elastic member may include an annular leaf spring.

The at least one elastic member may include an O-ring and an annular leaf spring.

In accordance with another aspect of embodiments, there is provided a washing machine including a rotary shaft, a bearing to rotatably retain the rotary shaft, an O-ring disposed between the rotary shaft and the bearing, and an annular leaf spring mounted to wrap an outside of the O-ring, the annular leaf spring having a diameter gradually decreasing from one side to the other side.

In accordance with another aspect of embodiments, there is provided a washing machine including a rotary shaft and a bearing to rotatably retain the rotary shaft, wherein the washing machine further includes at least one circular elastic member to separate a front-side step of the rotary shaft and an inner race of the bearing from each other and separate the rotary shaft and the inner race of the bearing from each other to prevent the interference between the rotary shaft and the inner race of the bearing.

The at least one circular elastic member may include an O-ring.

The at least one circular elastic member may include an annular leaf spring having a diameter gradually decreasing from one side to the other side.

The at least one circular elastic member may include an O-ring and an annular leaf spring.

The O-ring may be made of a rubber material.

The annular leaf spring may be made of an iron material.

In accordance with a further aspect of embodiments, there is provided a structure to prevent gap noise at a rotary shaft of a washing machine, including a rotary shaft, a bearing to rotatably retain the rotary shaft, and at least one circular elastic member disposed between a front-side step of the rotary shaft and a front-side bent portion of an inner race of the bearing.

The at least one circular elastic member may include an O-ring.

The at least one circular elastic member may include an annular leaf spring having a diameter gradually decreasing from one side to the other side.

The at least one circular elastic member may include an O-ring and an annular leaf spring.

The O-ring may be made of a rubber material.

The annular leaf spring may be made of an iron material.

In accordance with a further aspect of embodiments, there is provided a structure in a washing machine to prevent gap noise at a rotary shaft which is rotatably retained by a bearing, the structure comprising at least one circular elastic member disposed between a front-side step of the rotary shaft and a front-side bent portion of an inner race of the bearing.

Additional aspects and/or advantages of embodiments will be set forth in part in the description which follows and, in part, will be obvious from the description, or may be learned by practice of embodiments.

BRIEF DESCRIPTION OF THE DRAWINGS

These and/or other aspects and advantages will become apparent and more readily appreciated from the following description of exemplary embodiments, taken in conjunction with the accompanying drawings, of which.

DETAILED DESCRIPTION OF EMBODIMENTS

Figure 1:
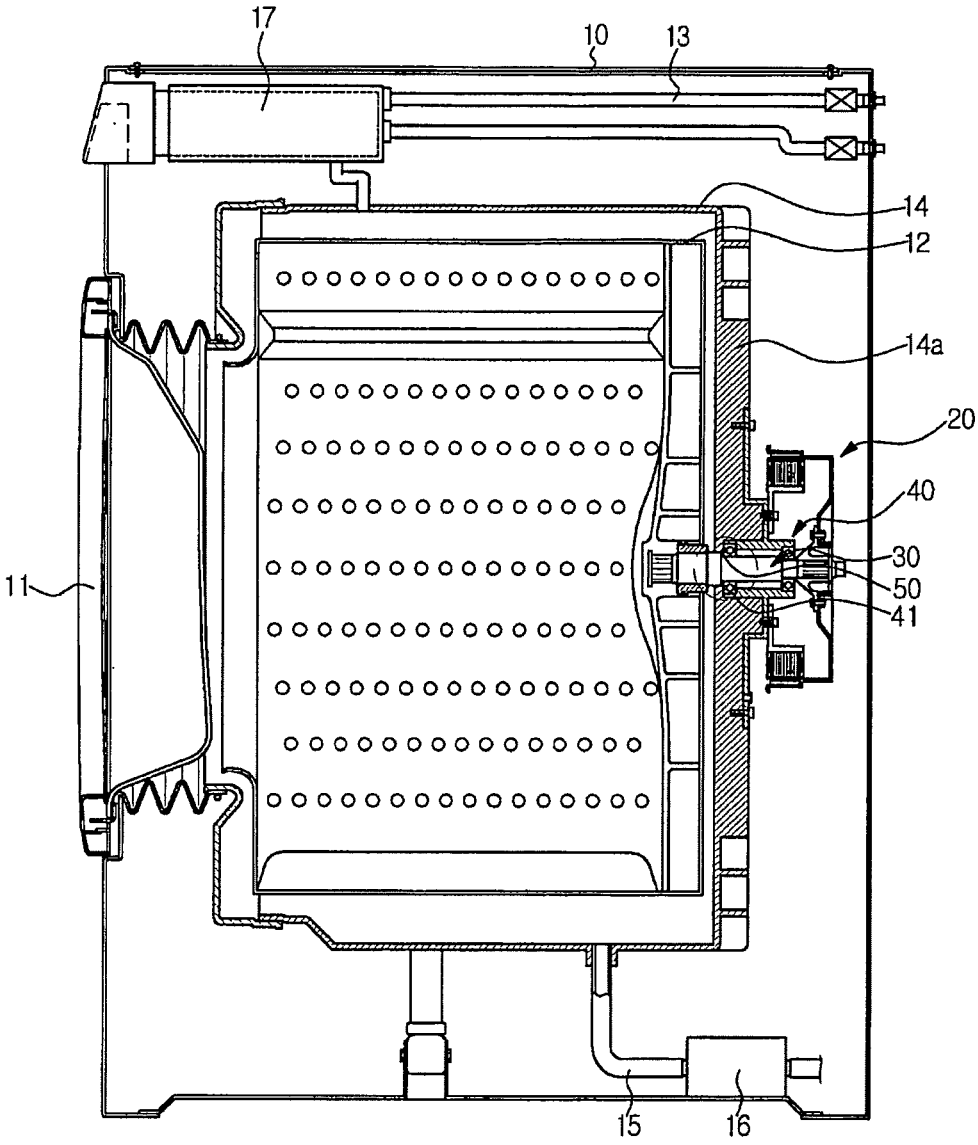
FIG. 1 is a sectional view schematically illustrating a drum type washing machine according to an exemplary embodiment.
Figure 2:
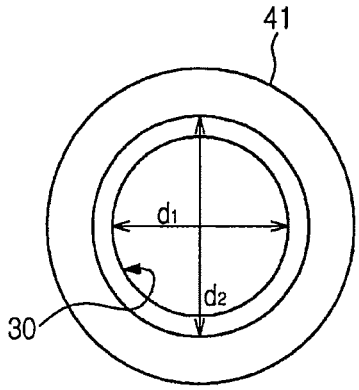
FIG. 2 is a view illustrating the assembly of a rotary shaft and a bearing of FIG. 1.

Reference will now be made in detail to exemplary embodiments, examples of which are illustrated in the accompanying drawings, wherein like reference numerals refer to like elements throughout. Exemplary embodiments are described below by referring to the figures.

As shown in FIG. 1, the washing machine includes a machine body 10 forming the appearance of the washing machine, a water tub 14 installed in the machine body 10 to receive wash water, a rotary tub 12 rotatably installed in the water tub 14 to wash laundry, and a door 11 installed at the front of the machine body 10 to open and close the front of the machine body 10.

At the upper inside of the machine body 10 are mounted a water supply pipe 13 to supply wash water and a detergent to the water tub 14 and a detergent supply unit 17. At the lower inside of the machine body 10 are mounted a drainage pipe 15 and a drainage pump 16 to drain wash water from the water tub 14 to the outside.

At the outside rear of the water tub 14 is mounted a drive motor 20 to rotate the rotary tub 12 in alternating directions. Between the rotary tub 12 and the drive motor 20 is mounted a rotary shaft 30 to transmit a drive force from the drive motor 20 to the rotary tub 12.

The rotary shaft 20 has one end connected to the rotary tub 12 and the other end coupled to a back 14*a* of the water tub 14 such that the other end is connected to the drive motor 20.

At the back 14*a* of the water tub 14 is mounted a bearing housing 40 to extend the rotary shaft 30 such that the rotary shaft 30 can rotate outside the water tub 14. The drive motor 20 is coupled to the back 14*a* of the water tub via the bearing housing 40.

Also, bearings 41 to rotatably retain the rotary shaft 30 are installed in the bearing housing 40 at the front and rear sides of the rotary shaft 30, respectively.

As shown in FIGS. 2 to 5, a gap is formed between the rotary shaft 30 and a bearing 41 to rotatably retain the rotary shaft 30.

That is, an outer diameter d1 of the rotary shaft 30 is not equal to an inner race d2 of the bearing 41. Consequently, a gap is formed between the inner race d2 of the bearing 41 and the outer diameter d1 of the rotary shaft 30. Due to the gap, there occurs a sliding phenomenon between the rotary shaft 30 and the bearing 41.

Also, between a front-side step 35 of the rotary shaft 30 and the front side of the inner race d2 of the bearing 41 is formed a gap, which causes noise and vibration.

In the washing machine, a circular elastic member 50 exhibiting elasticity is disposed between the outer diameter d1 of the rotary shaft 30 and the inner race d2 of the bearing 41, more exactly between the front-side step 35 of the rotary shaft 30 and a front-side bent portion 45 of the inner race d2 of the bearing 41. The circular elastic member 50 uniformly maintains the gap between the rotary shaft 30 and the bearing 41 and increases a frictional force between the rotary shaft 30 and the inner race d2 of the bearing 41. Consequently, the gap between the rotary shaft 30 and the bearing 41 is uniformly maintained by the circular elastic member 50, and the rotation speed of the rotary shaft 30 remains equal to that of the bearing 41, whereby the sliding between the rotary shaft 30 and the bearing 41 is prevented.

Therefore, it is possible to prevent the generation of creep noise due to the sliding between the rotary shaft 30 and the bearing 41.

The circular elastic member 50 is formed in a circular shape and made of an elastic material. The circular elastic member 50 is disposed between the outer diameter d1 of the rotary shaft 30 and the inner race d2 of the bearing 41, more exactly between the front-side step 35 of the rotary shaft 30 and the front-side bent portion 45 of the inner race d2 of the bearing 41.

Figure 3:
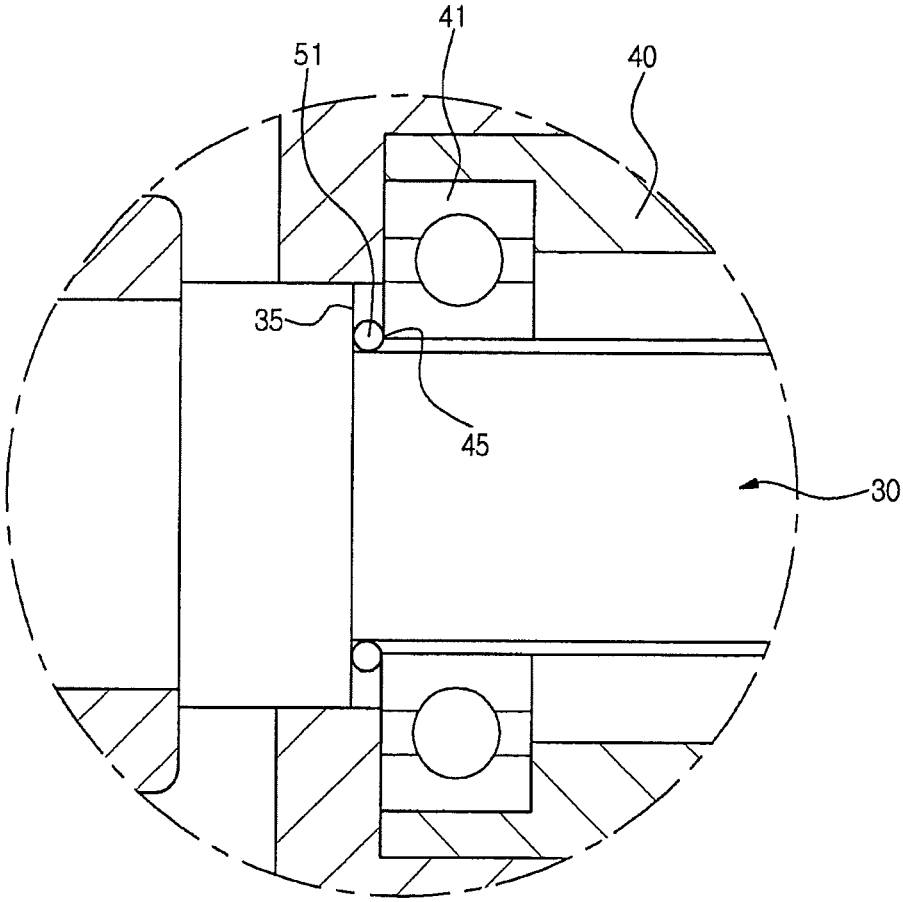
FIG. 3 is a sectional view illustrating an O-ring, mounted between the rotary shaft and the bearing, according to an exemplary embodiment.

FIG. 3 illustrates the circular elastic member 50 implemented by an O-ring 51, which is a ring having a circular section. The O-ring 51 may be made of a rubber material.

By fitting the O-ring 51 on the outer diameter of the rotary shaft 30 and coupling the bearing 41, it is possible to restrain the sliding between the rotary shaft 30 and the bearing 41 such that the rotary shaft 30 and the bearing 41 can rotate at a uniform speed.

Also, it is possible for the rotary shaft 30 and the bearing 41 to rotate at the same speed by the O-ring 51 disposed between the rotary shaft 30 and the bearing 41 even when the rotary shaft 30 and the bearing 41 rotate at high speed during spin-drying. Consequently, the sliding between the rotary shaft 30 and the bearing 41 is prevented, thereby restraining creep noise.

Figure 4:
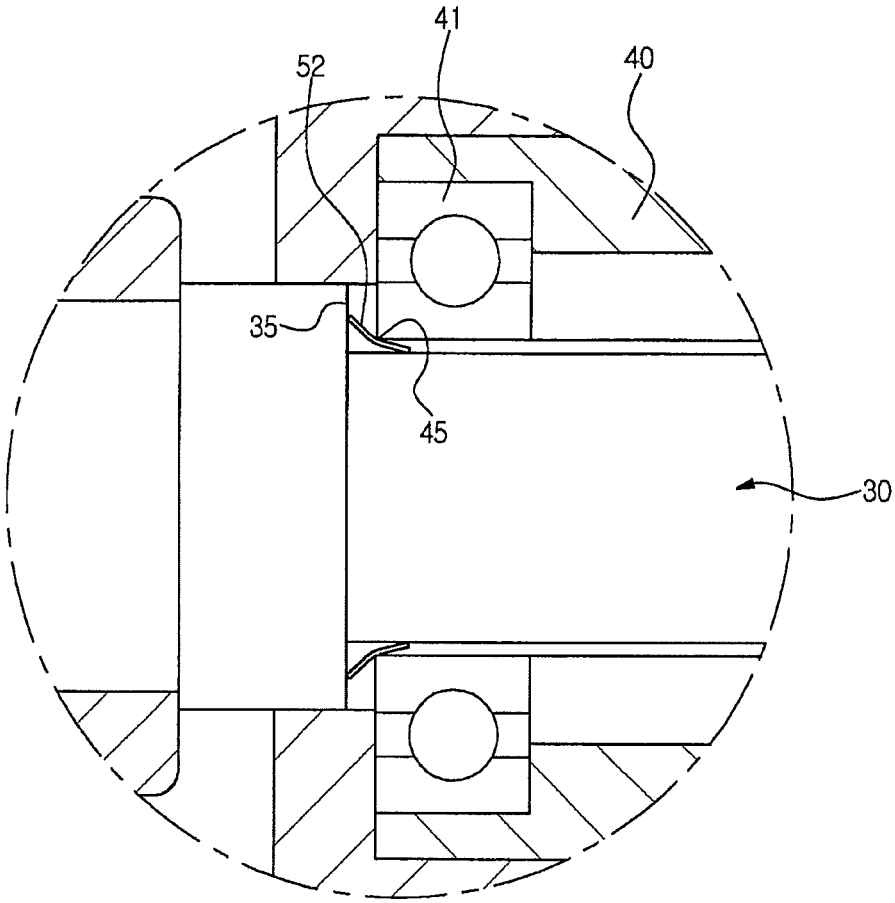
FIG. 4 is a sectional view illustrating an annular leaf spring, mounted between the rotary shaft and the bearing, according to another exemplary embodiment.

FIG. 4 illustrates another embodiment. Specifically, the circular elastic member 50 is implemented by an annular leaf spring 52. The diameter of one side of the leaf spring 52 is less than that of the other side of the leaf spring 52, and therefore, the leaf spring 52 has an incline. The leaf spring 52 may be of an iron material.

The leaf spring 52 is fitted on the outer surface of the rotary shaft 30, and the bearing 41 is assembled such that the bearing 41 is in contact with the outer incline of the leaf spring 52 fitted on the rotary shaft 30.

That is, the leaf spring 52 is disposed in the gap between the outer diameter d1 of the rotary shaft 30 and the inner race d2 of the bearing 41 to restrain the sliding between the rotary shaft 30 and the bearing 41.

Also, the rotary shaft 30 and the bearing 41 rotate at the same speed even when the rotary shaft 30 and the bearing 41 rotate at high speed, and there is no interference between the rotary shaft 30 and the bearing 41, thereby preventing the generation of creep noise between the rotary shaft 30 and the bearing 41.

Figure 5:
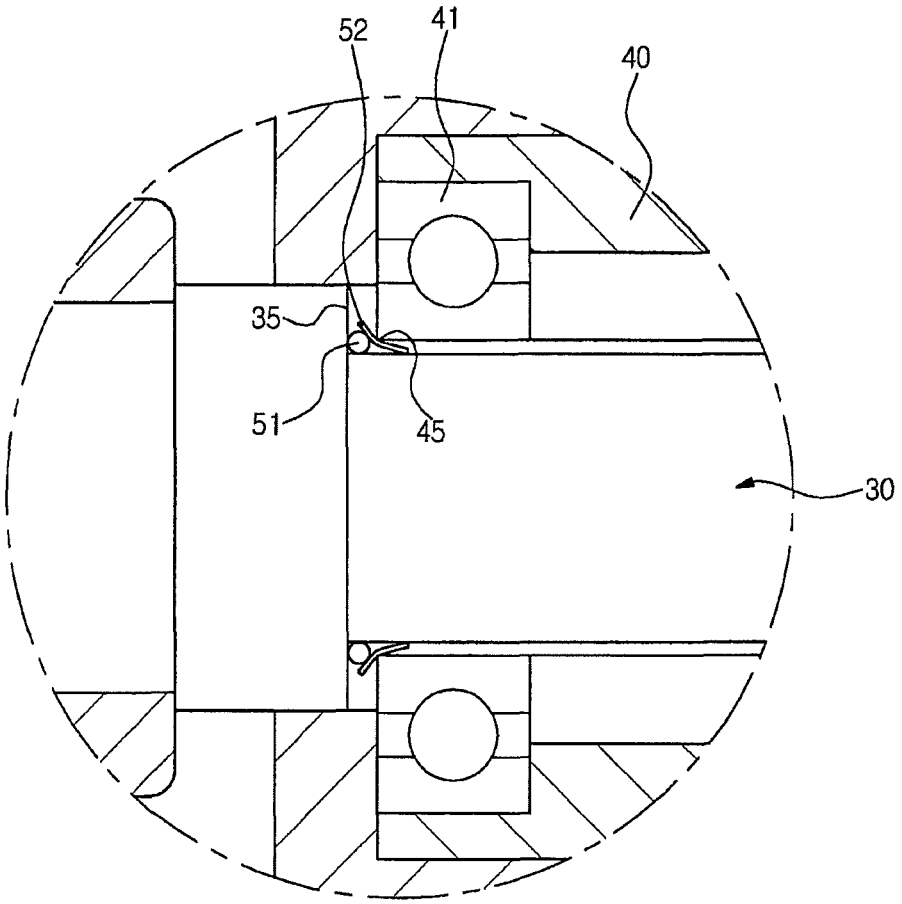
FIG. 5 is a sectional view illustrating an O-ring and a leaf spring, mounted between the rotary shaft and the bearing, according to a further exemplary embodiment.

FIG. 5 illustrates a further embodiment. Specifically, the circular elastic member 50 is implemented by a combination of the O-ring 51 and the annular leaf spring 52.

The O-ring 51 is fitted outside the rotary shaft 30 and the annular leaf spring 52 is coupled to the outside of the O-ring 51.

The O-ring 51 is in contact with the inner lower part of the leaf spring 52 to constrain the sliding between the rotary shaft 30 and the bearing 41, thereby preventing the generation of creep noise between the rotary shaft 30 and the bearing 41.

Table 1.1 shows measured values of noise and out-of-phase frequencies when using the O-ring 51 and the annular leaf spring 52.

TABLE 1.1

| Classification | Noise (dBA) | Out-of-phase frequency (Hz) |
|---|---|---|
| Wave washer (Conventional) | 57.6 | 41.8 |
| O-ring | 58.4 | — |
| Leaf spring | 56.6 | 41.5 |
| O-ring and Leaf spring | 54.4 | 44.6 |

As can be seen from Table 1.1, the noise was lower by 3.6 dBA when using the O-ring 51 and the annular leaf spring 52 than when using the conventional wave washer. Considering that the unit dBA is a log scale, the noise reduction effect is considerably remarkable. The out-of-phase frequency also increased.

Hereinafter, a process to constrain creep noise during spin-drying according to the finally mentioned embodiment will be described.

When a user operates the washing machine in a spin-drying mode, the drive motor 20 is operated to rotate the rotary shaft and the rotary tub 12, connected to the rotary shaft 30, at high speed to perform a spin-drying process. At this time, the inner race d2 of the bearing 41 rotates at the same speed as the rotary shaft 30 by the O-ring 51 and the annular leaf spring 52 disposed between the front-side step 35 of the rotary shaft 30 and the front-side bent portion 45 of the inner race d2 of the bearing 41, whereby the generation of creep noise is constrained. This is because the O-ring 51 and the annular leaf spring 52 uniformly maintain the gap between the rotary shaft 30 and the inner race d2 of the bearing 41 and provide a great frictional force to constrain the sliding between the rotary shaft 30 and the bearing 41.

As apparent from the above description, the O-ring and the leaf spring are disposed between the outer diameter of the rotary shaft and the inner race of the bearing in the washing machine to constrain the sliding between the rotary shaft and the bearing. Consequently, the embodiments have the effect of preventing creep noise and vibration.

Also, the smooth rotation of the rotary shaft and the bearing is achieved. Consequently, embodiments have the effect of improving the durability and life span of the bearing.

Also, the O-ring and the leaf spring are not deformed even after the long-term use of the washing machine. Consequently, embodiments have the effect of preventing the increase of noise and vibration.

Although a few exemplary embodiments have been shown and described, it would be appreciated by those skilled in the art that changes may be made in exemplary embodiments without departing from the principles and spirit of embodiments, the scope of which is defined in the claims and their equivalents.

What is claimed is:

1. A washing machine comprising:

a water tub;

a rotary tub rotatably installed in the water tub;

a drive motor to rotate the rotary tub;

a rotary shaft to transmit a drive force from the drive motor to the rotary tub; and a bearing housing supporting a bearing to rotatably retain the rotary shaft, the bearing having an inner race to rotate together with the rotary shaft, an outer race affixed to the bearing housing, and a plurality of balls movably disposed between the inner race and the outer race, wherein an elastic member is configured to exert pressure to the inner race of the bearing and the outer diameter of the rotary shaft to constrain a sliding between the rotary shaft and the inner race of the bearing to reduce noise and vibration of the washing machine, and wherein the elastic member comprises an annular leaf spring adapted to uniformly maintain a gap formed between the inner race of the bearing and the outer diameter of the rotary shaft and to increase a friction force between the rotary shaft and the inner race of the bearing such that a sliding between the rotary shaft and the inner race of the bearing is constrained.

2. The washing machine according to claim 1, wherein the elastic member serves to increase a friction force between the rotary shaft and the inner race of the bearing so that the rotary shaft and the inner race of the bearing can rotate together by the plurality of the balls of the bearing without the rotary shaft slipping with respect to the inner race of the bearing.

3. A washing machine comprising:

a rotary shaft;

a bearing housing supporting a bearing to rotatably retain the rotary shaft, the bearing having an inner race to rotate together with the rotary shaft, an outer race affixed to the bearing housing, and a plurality of balls movably disposed between the inner race and the outer race; and an annular leaf spring mounted to wrap an outside of the rotary shaft, the annular leaf spring having a diameter gradually decreasing from one side to the other side, wherein the annular leaf spring are adapted to uniformly maintain a gap formed between the inner race of the bearing and the outer diameter of the rotary shaft, to exert pressure to the inner race of the bearing and the outer diameter of the rotary shaft, and to increase a friction force between the rotary shaft and the inner race of the bearing such that a sliding between the rotary shaft and the inner race of the bearing is constrained to reduce noise and vibration of the washing machine.

4. A washing machine comprising a rotary shaft and a bearing to rotatably retain the rotary shaft, wherein the washing machine further comprises at least one circular elastic member to separate a front-side step of the rotary shaft and an inner race of the bearing from each other and separate the rotary shaft and the inner race of the bearing from each other to prevent an interference between the rotary shaft and the inner race of the bearing, wherein a portion of the at least one circular elastic member is disposed between an outer diameter of the rotary shaft and the inner race of the bearing to exert pressure to the inner race of the bearing and the outer diameter of the rotary shaft to constrain a sliding between the rotary shaft and the inner race of the bearing to reduce noise and vibration of the washing machine, and wherein the at least one circular elastic member comprises an annular leaf spring.

5. The washing machine according to claim 4, the annular leaf spring has a diameter gradually decreasing from one side to the other side.

6. The washing machine according to claim 4, wherein the annular leaf spring is made of an iron material.

7. A structure in a washing machine to prevent gap noise at a rotary shaft which is rotatably retained by a bearing, the structure comprising at least one circular elastic member disposed between a front-side step of the rotary shaft and a front-side bent portion of an inner race of the bearing to exert pressure to the inner race of the bearing and the outer diameter of the rotary shaft to constrain a sliding between the rotary shaft and the inner race of the bearing to reduce noise and vibration of the washing machine, wherein the at least one circular elastic member comprises an annular leaf spring.

8. The structure according to claim 7, the annular leaf spring has a diameter gradually decreasing from one side to the other side.

9. The structure according to claim 7, wherein the annular leaf spring is made of an iron material.

* * * * *